US010327531B2

(12) United States Patent
Cho et al.

(10) Patent No.: US 10,327,531 B2
(45) Date of Patent: Jun. 25, 2019

(54) COSMETICS CONTAINER

(71) Applicant: SAMWHA PLASTIC IND.CO., Uiwang-si (KR)

(72) Inventors: Sung-Hwan Cho, Seoul (KR); Kyung-Chang Lee, Uiwang-si (KR)

(73) Assignee: SAMWHA PLASTIC IND.CO., Uiwang-si (KR)

( * ) Notice: Subject to any disclaimer, the term of this patent is extended or adjusted under 35 U.S.C. 154(b) by 0 days.

(21) Appl. No.: 15/810,164

(22) Filed: Nov. 13, 2017

(65) Prior Publication Data

US 2018/0078019 A1 Mar. 22, 2018

Related U.S. Application Data

(63) Continuation of application No. PCT/KR2016/004954, filed on May 12, 2016.

(30) Foreign Application Priority Data

May 13, 2015 (KR) ..... 10-2015-0066782

(51) Int. Cl.
*A45D 34/04* (2006.01)
*A45D 34/00* (2006.01)
(Continued)

(52) U.S. Cl.
CPC ..... *A45D 34/04* (2013.01); *A45D 34/00* (2013.01); *A45D 40/0075* (2013.01);
(Continued)

(58) Field of Classification Search
CPC .. A45D 34/04; A45D 2200/054; A45D 40/22; A45D 40/0075; A45D 34/00;
(Continued)

(56) References Cited

U.S. PATENT DOCUMENTS 5,617,976 A * 4/1997 Gueret ..... B05B 11/0029 222/380
5,697,529 A * 12/1997 Lecomte ..... B05B 11/0005 222/256
(Continued)

FOREIGN PATENT DOCUMENTS

JP 2012-235841 A 12/2012
KR 10-0903973 B1 6/2009
(Continued)

OTHER PUBLICATIONS

International Search Report dated Aug. 8, 2016 for PCT/KR2016/004954.
(Continued)

*Primary Examiner* — Donnell A Long

(57) ABSTRACT

Various examples related to a cosmetics container are disclosed. According to one example, the cosmetics container can comprise: an outer container part; an inner container part coupled in the outer container part and containing cosmetics therein; first and second moving parts provided at the upper and lower parts of the inner container part and moving the cosmetics by pressure; a side button part provided on the side surface of the outer container part; and a side pumping part mounted on the side surface of the inner container part, connected to the first and second moving parts, and providing pressure and moving the cosmetics from the first moving part to the second moving part by the pressure, whenever the side button part is pressed to reciprocate left and right. Additionally, other various examples are possible.

13 Claims, 14 Drawing Sheets

(51) Int. Cl.

| | |
|---|---|
| ***B05B 11/00*** | (2006.01) |
| ***A45D 40/00*** | (2006.01) |
| ***A45D 40/22*** | (2006.01) |
| *B65D 47/00* | (2006.01) |
| *B05B 1/14* | (2006.01) |

(52) U.S. Cl.
CPC ..... *A45D 40/22* (2013.01); *B05B 11/00418* (2018.08); *B05B 11/3015* (2013.01); *B05B 11/3023* (2013.01); *A45D 2200/054* (2013.01); *A45D 2200/056* (2013.01); *B05B 1/14* (2013.01); *B05B 11/0032* (2013.01); *B05B 11/0038* (2018.08); *B05B 11/3001* (2013.01); *B05B 11/3074* (2013.01); *B65D 47/00* (2013.01)

(58) Field of Classification Search
CPC ..... A45D 2200/056; B65D 47/00; B05B 11/3001; B05B 11/00418; B05B 11/3015; B05B 11/3023; B05B 11/0038; B05B 11/3074; B05B 11/0032; B05B 1/14
See application file for complete search history.

(56) References Cited

U.S. PATENT DOCUMENTS

| | | | | |
|---|---|---|---|---|
| 2014/0001210 | A1* | 1/2014 | Lim ..... | A45D 33/006 222/162 |
| 2016/0158777 | A1 | 6/2016 | Kang | |
| 2017/0280853 | A1* | 10/2017 | Castex ..... | A46B 11/0006 |

FOREIGN PATENT DOCUMENTS

| | | | |
|---|---|---|---|
| KR | 10-2014-0026694 | A | 3/2014 |
| KR | 20-0471797 | Y1 | 3/2014 |
| KR | 10-1448829 | B1 | 10/2014 |
| KR | 10-2015-0041960 | A | 4/2015 |
| WO | 2015/008968 | A1 | 1/2015 |

OTHER PUBLICATIONS

Extended European Search Report for 16792999.1, dated Aug. 1, 2018.

* cited by examiner

COSMETICS CONTAINER

PRIORITY

This application is continuation of International Application No. PCT/KR2016/004954 filed on May 12, 2016, which claims priority to Korean Application No. 10-2015-0066782 filed on May 13, 2015, which applications are incorporated herein by reference.

TECHNICAL FIELD

Various embodiments of the present disclosure relate to a cosmetic vessel used for applying makeup.

BACKGROUND

In general, cosmetics have various forms such as powder, liquid, gel, cream, or solid, and these cosmetics are contained in various cosmetic vessels for use thereof That is, the cosmetics are classified into cold cream, massage cream, or nourishing cream depending on the usage thereof, all of which are liquid. A user takes the cosmetics from the cosmetic vessel with a finger and applies the same to a target area of the skin, and the cosmetics are stored in the vessel by rotating a lid to close the same after use.

Since the cosmetics are taken from the cosmetic vessel using a finger, there is a problem in which the cosmetics may be contaminated with foreign matters from the finger to thus spoil.

In order to solve the above-mentioned problem, a cosmetic vessel equipped with a pressurized pumping device for discharging a predetermined amount of cosmetic substance by pressing the same has been developed.

As shown in FIGS. 1 and 2, a pressurized pumping device 1 is installed on a nozzle cap installed to open or close an outlet 2*b* of a cosmetic vessel 2, which has a piston 2*a* provided therein and contains a cosmetic substance therein. When an operating button 1*a* is pressed by a finger, vacuum pressure is generated inside the container 2 by the pressing of the operating button, and the vacuum pressure allows a predetermined amount of cosmetic substance stored in the cosmetic vessel 2 to be discharged to the outside through the nozzle 1*b*. At this time, the pressurized pumping device 1 is provided inside the outer cover 3.

As described above, the pressurized pumping device 1 is configured such that when the user presses the operating button 1*a*, the pressing causes a change in the pressure inside the pumping device 1, and a predetermined amount of cosmetic substance contained in the cosmetic vessel 2 is discharged through the nozzle 1*b*.

However, the cosmetic vessel equipped with the conventional pressurized pumping device is configured such that the pumping device and the operating button are located directly above the cosmetic vessel containing the cosmetic substance so that the cosmetic substance is discharged by the ascending and descending of the button. Therefore, since the nozzle formed on one side of the operating button goes up and down, the cosmetic substance cannot be correctly discharged onto the user's hands, and thus the cosmetic substance may deviate from the user's hands or may spill on the floor. In addition, the conventional pressurized pumping device has a structure in which the cosmetic substance is discharged when the operating button is pushed once from the top down. Thus, if a small amount of cosmetic substance is discharged when the user presses the operating button once, the user must repeatedly press the operating button several times from the top down, which is tiresome to the user.

As a result, the cosmetic vessel adopting the pressurized pumping device requires a device that has an operating button provided on the side of the cosmetic vessel and discharges the cosmetic substance onto the upper portion of the cosmetic vessel for use, instead of discharging the cosmetic substance directly to the user's hands, when the operating button is pressed. Further, the cosmetic vessel requires a device for discharging the cosmetic substance when both pressing and releasing the operating button rather than the conventional configuration in which the cosmetic substance is discharged only when pressing the operating button.

In other words, there is a demand for a device capable of reducing the number of times a pumping operation is performed by half, compared to the conventional pumping device, in order to discharge the same amount of cosmetic substance.

SUMMARY

Various embodiments of the present disclosure provide a cosmetic vessel that has a pump and discharges a liquid cosmetic substance by the pumping of a lateral pump provided on the side thereof.

Various embodiments of the present disclosure provide a cosmetic vessel in which the cosmetic substance is discharged to the upper portion of an outer container when pressing or releasing a lateral button provided on the side of the outer container, thereby preventing the cosmetic substance from being discharged directly onto the user's hands. In addition, various embodiments of the present disclosure provide a cosmetic vessel that adopts a lateral pump for discharging the cosmetic substance by pressure when the lateral button is pressed or released, thereby reducing the number of times a pumping operation is performed by half, compared with the existing pumping device, for discharging the same amount of cosmetic substance.

According to various embodiments of the present disclosure, there is provided a cosmetic vessel including:

an outer container; an inner container that is coupled inside the outer container, and receives the cosmetic substance therein; first and second movement members that are provided in upper and lower portions of the inner container, and move the cosmetic substance by pressure; a lateral button that is provided on the side of the outer container; and a lateral pump that is mounted on the side of the inner container so as to be connected to the first and second movement members, and provides the pressure every time the lateral button is pressed and released to reciprocate left and right so as to move the cosmetic substance from the first movement member to the second movement member by the pressure.

According to various embodiments of the present disclosure, there is provided a cosmetic vessel including:

an outer container; an inner container that is coupled inside the outer container so as to receive the cosmetic substance and a piston therein, and that discharges the cosmetic substance to the outer container by the descent of the piston; first and second movement members that are provided in upper and lower portions of the inner container, and move the cosmetic substance by pressure; a lateral button that is provided on the side of the outer container; and a lateral pump that is mounted on the side of the inner container so as to be connected to the first and second movement members, and provides the pressure every time the lateral button is pressed and released to reciprocate left and right so as to move the cosmetic substance from the first movement member to the second movement member by the pressure.

According to various embodiments of the present disclosure, since the cosmetic substance is discharged to the upper portion of the outer container when pressing or releasing the lateral button left or right, which is provided on the side of the outer container, it is possible to prevent the cosmetic substance from being discharged directly to the user's hands and to prevent the cosmetic substance from spilling from the user's hands to thus be wasted. In addition, it is possible to reduce the number of times a pumping operation is performed by half, compared with the existing pumping device, for discharging a predetermined amount of cosmetic substance by configuring a lateral pump for discharging the cosmetic substance by pressure when the lateral button is pressed or released.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Terms used in various embodiments of the present disclosure will be described in brief first, and then the various embodiments of the present disclosure will be described in detail.

Although the terms used in various embodiments of the present disclosure have been selected as far as possible from generic terms that are currently and widely used, taking into account functions thereof in various embodiments of the present disclosure, the terms may vary depending on intentions of those skilled in the art, precedents, or the emergence of new technologies. In addition, in some cases, there may be terms arbitrarily selected by the applicant, and the meanings thereof will be described in detail in the corresponding description of the various embodiments of the present disclosure. Thus, the terms used in various embodiments of the present disclosure should be defined based on the meanings of the terms and the overall contents of the embodiments of the present disclosure instead of simple titles of the terms.

Although the terms including an ordinal number such as first, second, etc. can be used for describing various elements, the structural elements are not restricted by the terms. The terms are used merely for the purpose to distinguish an element from the other elements.

For example, a first element could be termed a second element, and similarly, a second element could be also termed a first element without departing from the scope of the present disclosure.

Hereinafter, the cosmetic substance is formed of one of either a liquid cosmetic product or a powder cosmetic product. Although the present embodiments will be described with reference to examples for use with the liquid cosmetic product or the powder cosmetic product, the present disclosure is not limited thereto. That is, the present disclosure can be applied to other cosmetic products, as well as the liquid cosmetic product or the powder cosmetic product described above. Hereinafter, a description will be made of an embodiment using a liquid cosmetic product.

Figure 1:
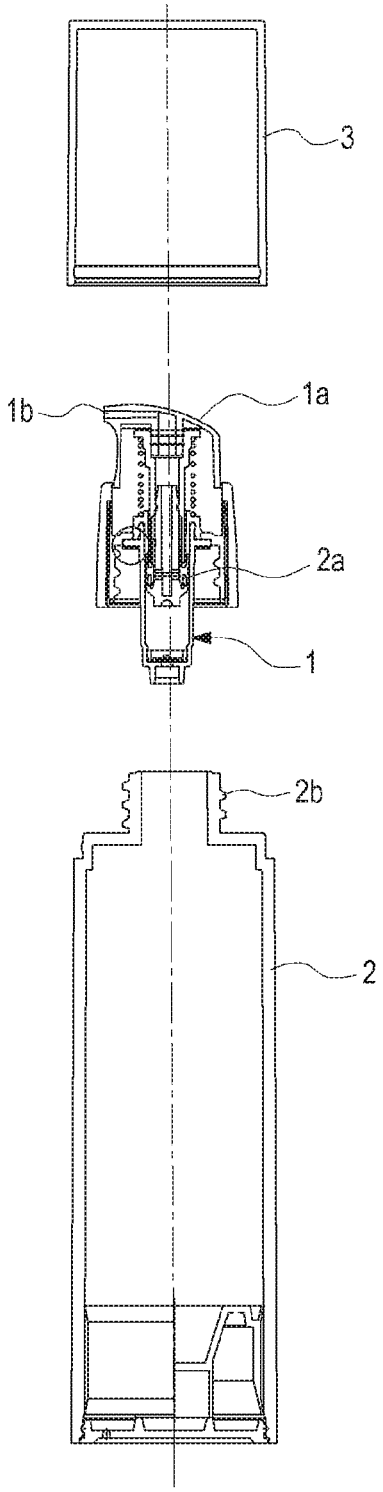
FIG.1 (PRIOR ART)
FIG. 1 is an exploded cross-sectional side view showing the configuration of a cosmetic vessel adopting a conventional pressurized pumping device.
Figure 2:
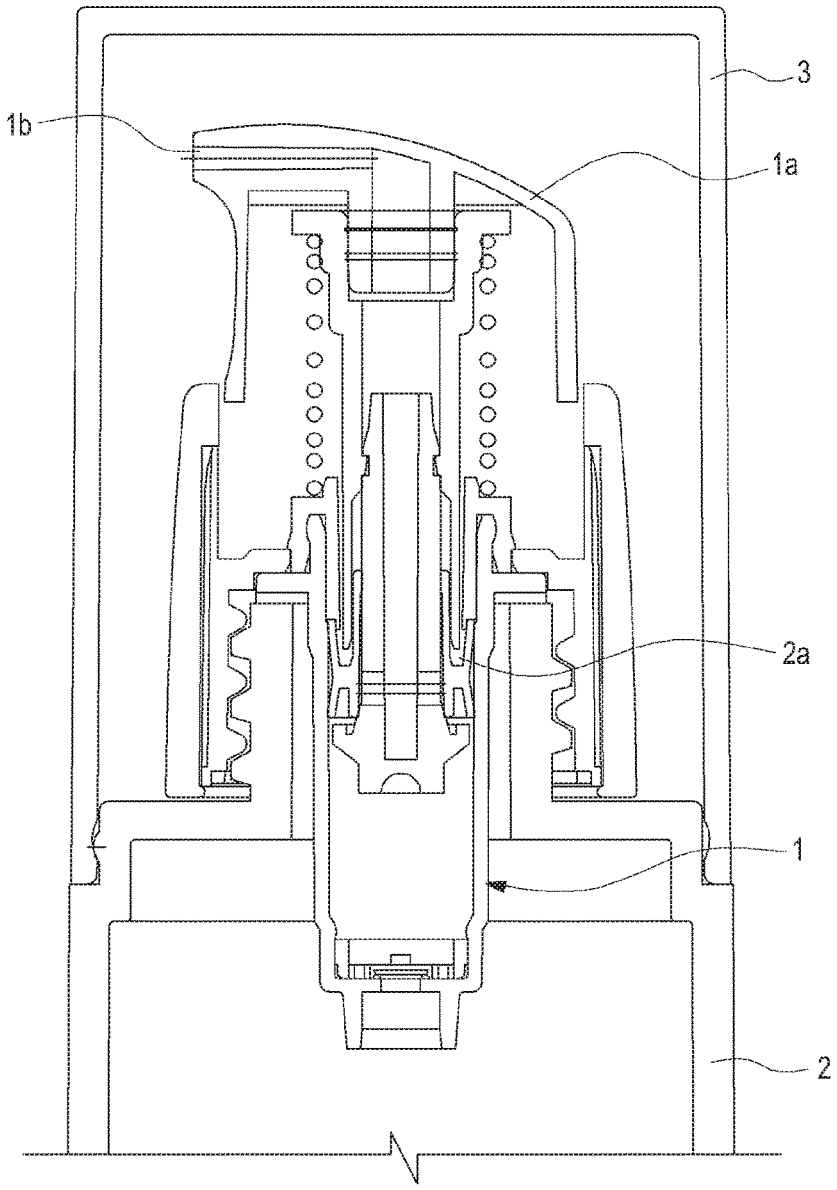
FIG.2 (PRIOR ART)
FIG. 2 is a cross-sectional side view showing the combined state of a cosmetic vessel adopting a conventional pressurized pumping device.
Figure 3:
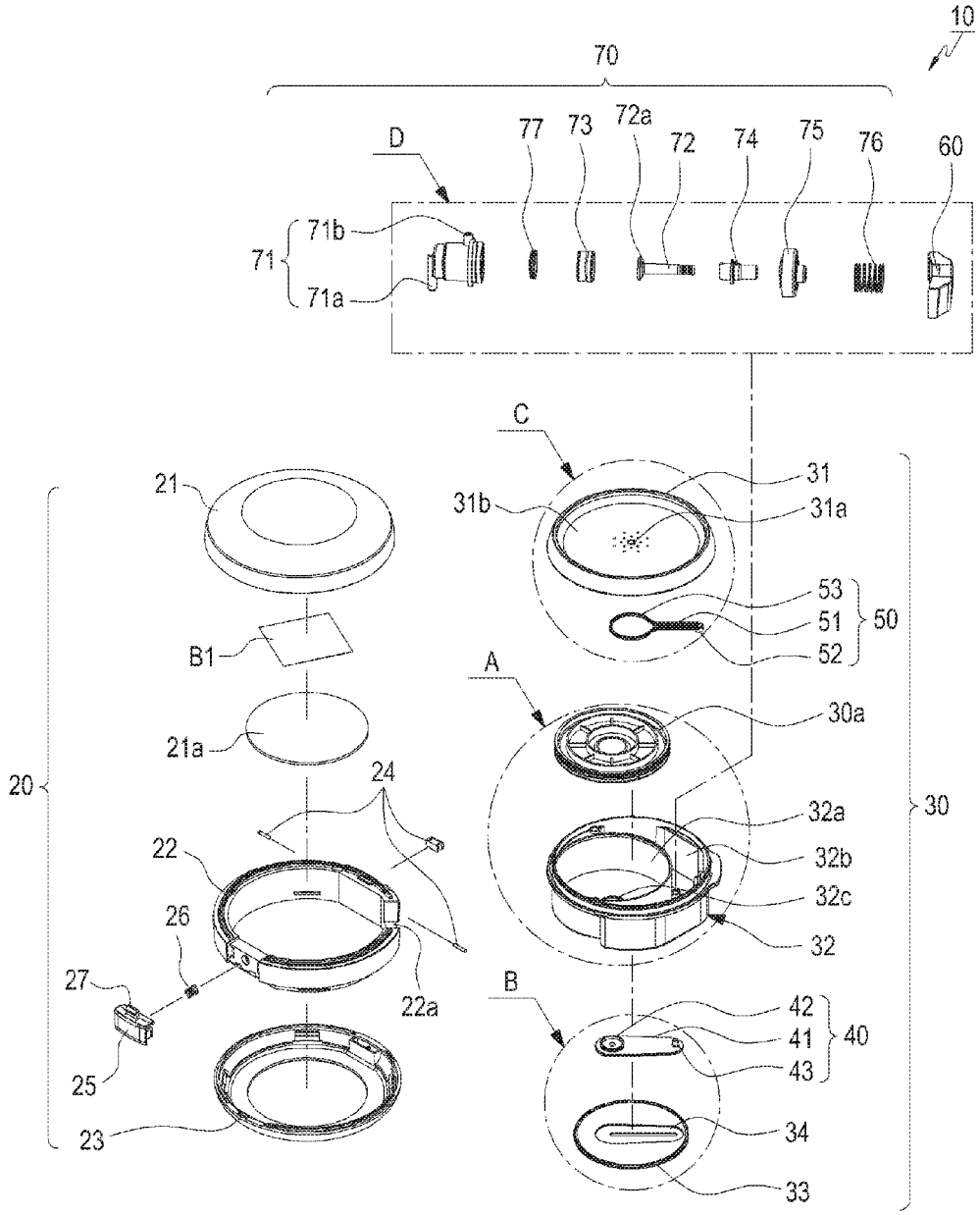
FIG. 3 is an exploded perspective view showing the configuration of a cosmetic vessel according to various embodiments of the present disclosure.
Figure 4:
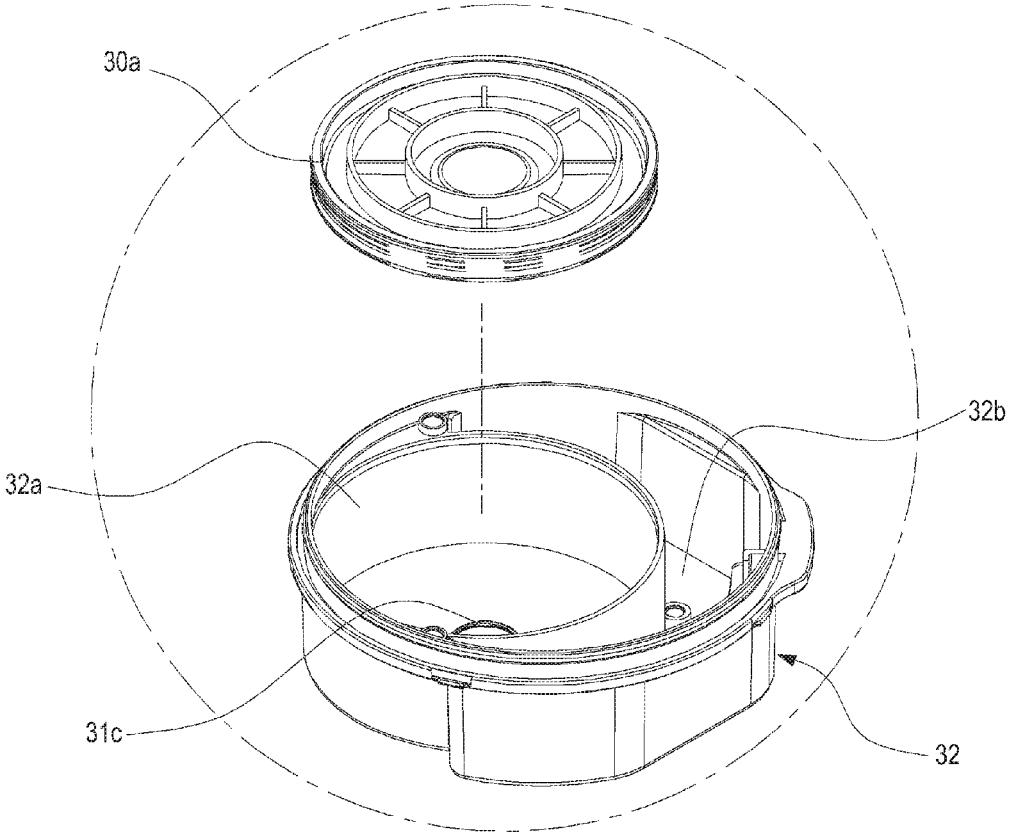
FIG. 4 is an enlarged perspective view of part A in FIG. 3.
Figure 5:
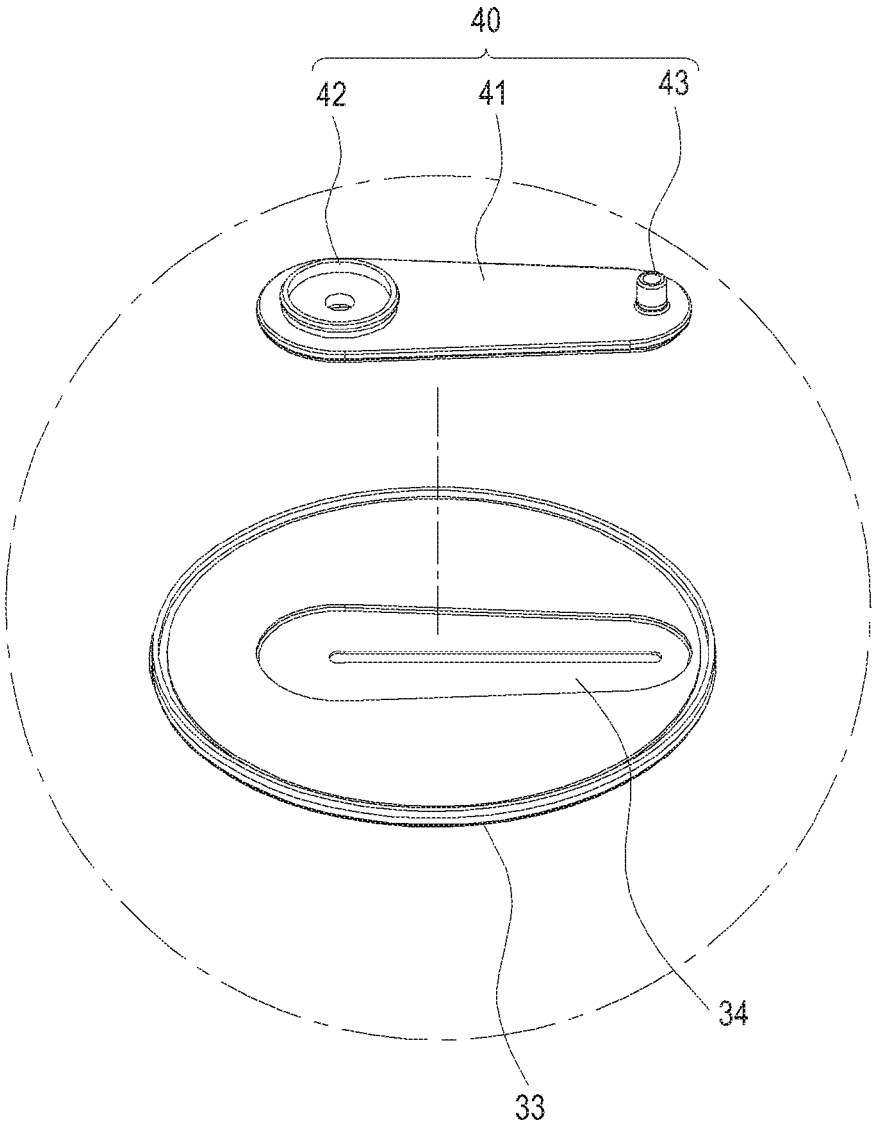
FIG. 5 is an enlarged perspective view of part B in FIG. 3.
Figure 6:
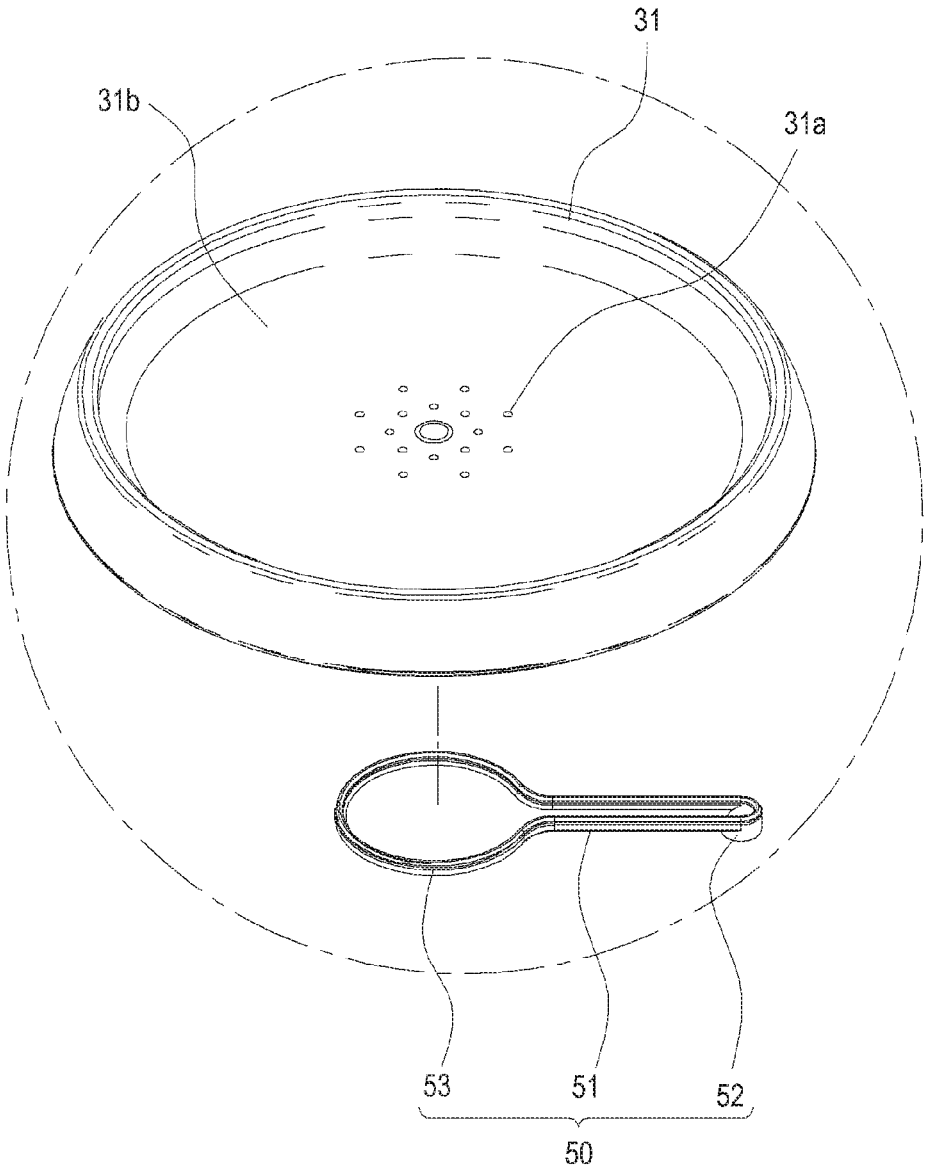
FIG. 6 is an enlarged perspective view of part C in FIG. 3.
Figure 7:
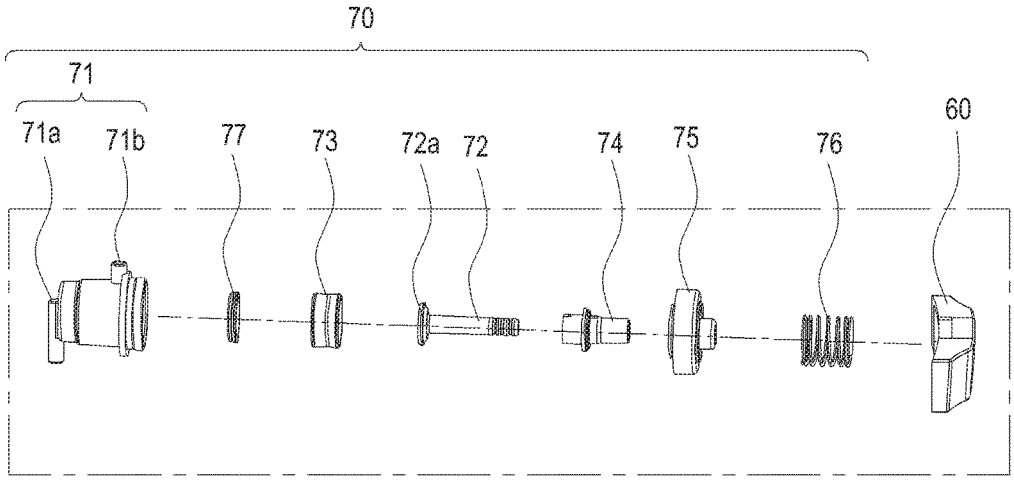
FIG. 7 is an enlarged perspective view of part D in FIG. 3.

FIG. 3 is an exploded perspective view showing the configuration of a cosmetic vessel 10 according to the present disclosure, and FIG. 4 is an enlarged perspective view of part A in FIG. 3, which shows a middle container part 32 in the configuration of an inner container 30. FIG. 5 is an enlarged perspective view of part B in FIG. 3, which shows a first movement member 40, and FIG. 6 is an enlarged perspective view of part C in FIG. 3, which shows a second movement member 50. In addition, FIG. 7 is an enlarged perspective view of part D in FIG. 3, which shows a lateral pump 70.

Referring to FIGS. 3 to 7, the configuration of a cosmetic vessel 10 will be described. As shown in FIG. 3, the cosmetic vessel 10 includes an outer container 20, an inner container 30, first and second movement members 40 and 50, a lateral button 60, and a lateral pump 70.

The outer container 20 is configured to receive the inner container 30, which will be described later.

The inner container 30 has a cosmetic substance A1 and a piston 30*a* provided therein, and is coupled inside the outer container 20 so as to discharge the cosmetic substance Alto the outer container 20 by descent of the piston 30*a*.

The first movement member 40 is provided in a lower portion of the inner container 30 so as to move the cosmetic substance A1 to the lateral pump 70, which will be described later, by pressure.

The second movement member 50 is provided in an upper portion of the inner container 30 so as to move the cosmetic substance A1 discharged from the lateral pump 70 to the outer container 20 by pressure.

The lateral button 60 is mounted in the side of the inner container 30 so as to be connected with the first and second movement members 40 and 50, and so as to apply pressure every time the lateral button 60 is presses and released left and right, thereby moving the cosmetic substance A1 from the first movement member 40 to the second movement member 50.

As described above, when the lateral button 60 provided on the side of the outer container 20 is pressed or released, the cosmetic substance A1 may be discharged by the pressure of the lateral pump 70 from the inner container 30 to the outer container 20 through the first and second movement members 40 and 50. At this time, since the cosmetic substance A1 is discharged to the outer container 20 temporarily, instead of allowing the cosmetic substance A1 to be discharged directly onto the user's hands, it is possible to prevent the cosmetic substance A1 from spilling from the user's hands to thus be wasted. Further, it is possible to facilitate the discharge of the cosmetic substance A1 by allowing the cosmetic substance A1 to be discharged both when pressing and when releasing the button, compared to the prior art, in which the cosmetic substance A1 is discharged only when pressing the button.

Now, the outer container 20 will be described in more detail. First, as shown in FIG. 3, the outer container 20 includes an upper case 21, a middle case 22, and a lower case 23.

The upper case 21 is pivotably coupled to the middle case 22, which will be described below, to open and close the middle case 22. In addition, a mirror 21*a* is mounted inside the upper case 21 by an adhesive tape B1.

The middle case 22 is pivotably coupled to the upper case 21 by a hinge 24, and the inner container 30 is received in the middle case 22.

The lower case 23 is provided in a lower portion of the middle case 22 so as to be connected with a first movement path 34, which will be described later.

That is, the upper case 21 is pivotably coupled to the middle case 22 by the hinge 24, and the lower case 23 is coupled to the lower portion of the middle case 22 so as to provide the first movement member 40. In addition, the middle case 22 is provided between the upper case 21 and the lower case 23 so as to adopt the inner container 30, the lateral button 60, and the lateral pump 70.

Further, the middle case 22 includes a push button 25 and a push spring 26. The push button 25 is provided on the outer side of the middle case 22 so as to stop the pivoting of the upper case 21 by locking the same when it is pushed or allow the pivoting of the upper case 21 by releasing the locked state.

The push spring 26 is provided in the back side of the push button 25 so as to provide an elastic force in order to move the push button 25.

That is, the push button 25 has a hook 27 that is engaged with or disengaged from a locking groove 21*b* formed in the upper case 21. Therefore, when the push button 25 provided on the outer side of the middle case 22 is pushed, the push button 25 is moved toward the inside of the case and is disengaged from the locking groove 21*b* in the upper case 21 to release the locked state, so that the upper case 21 can pivot away from the middle case 22 around the hinge 24. When the upper case 21 is closed, the upper case 21 approaches the middle case 22 and the hook 27 of the push button 25 is inserted into the locking groove 21*b* in the upper case 21 to then be locked therein In addition, the middle case 22 has a seating hole 22*a* formed to seat the lateral button 60 therein.

Further, the inner container 30 will be described in more detail as follows. First, as shown in FIGS. 3 and 4, the inner container 30 includes an upper container part 31, a middle container part 32, and a lower container part 33. The middle container part 32 has a first receiving room 32*a* formed to contain the cosmetic substance A1 and the piston 30*a*, and a second receiving room 32*b*, which is formed adjacent to the first receiving room 32*a*, for receiving the lateral pump 70.

The lower container part 33 is provided in a lower portion of the middle container part 32 so as to be coupled to the lower case 23, and forms a first movement path 34 thereon so as to be connected with the first movement member 40, through which the cosmetic substance A1 is moved.

The upper container part 31 is provided in an upper portion of the middle container part 32 so as to be coupled to the second movement member 50, and forms a second movement path 35 thereon to move the cosmetic substance A1.

In addition, the upper container part 31 has a plurality of outer discharge holes 31*a* formed to discharge the cosmetic substance A1 to the outside. Further, the upper container part 31 has a discharge recess 31*b* formed to receive the cosmetic substance A1 discharged through the outer discharge holes 31*a*.

That is, when the lateral button 60 is pressed or released, the cosmetic substance A1 is discharged to the discharge recess 31*b* by the pressure of the lateral pump 70 through the outer discharge holes 31*a*. Then, the user may use the cosmetic substance A1 discharged onto the discharge recess 31*b*.

Figure 10:
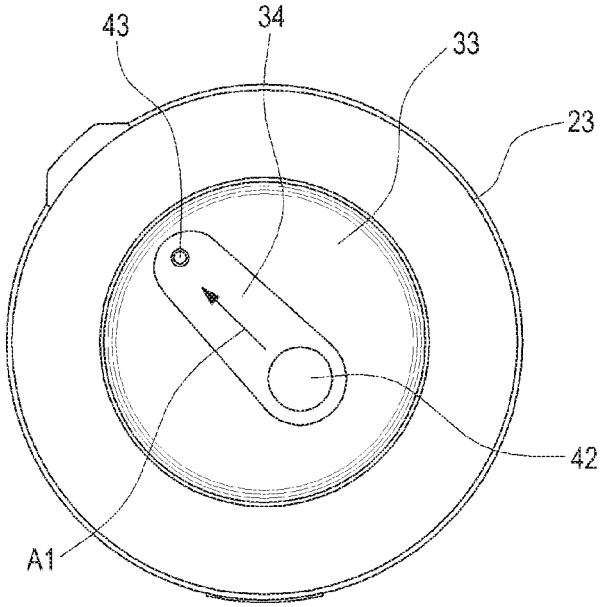
FIG. 10 is a plan view showing the combined state of a lower case and a lower container part in the configuration of a cosmetic vessel according to various embodiments of the present disclosure.
Figure 11:
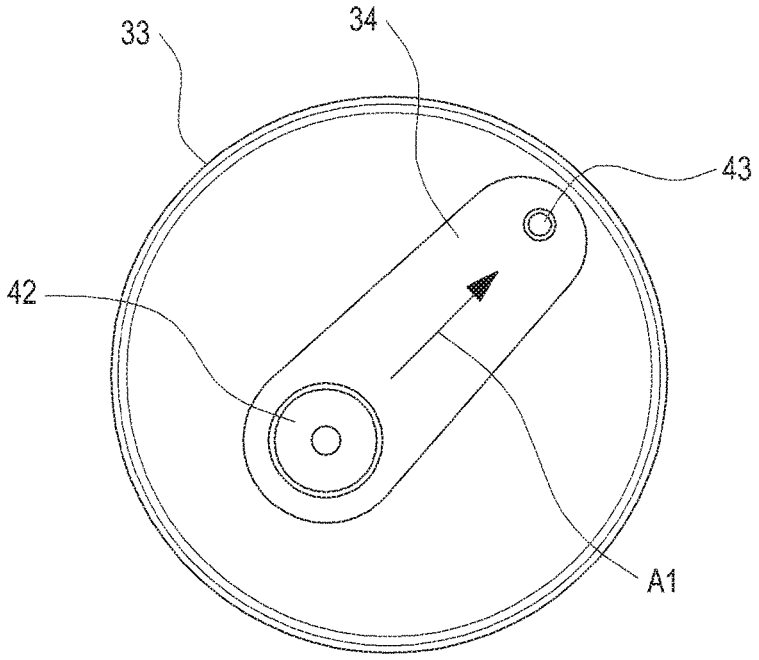
FIG. 11 is a plan view showing a first movement member in the configuration of a cosmetic vessel according to various embodiments of the present disclosure.
Figure 12:
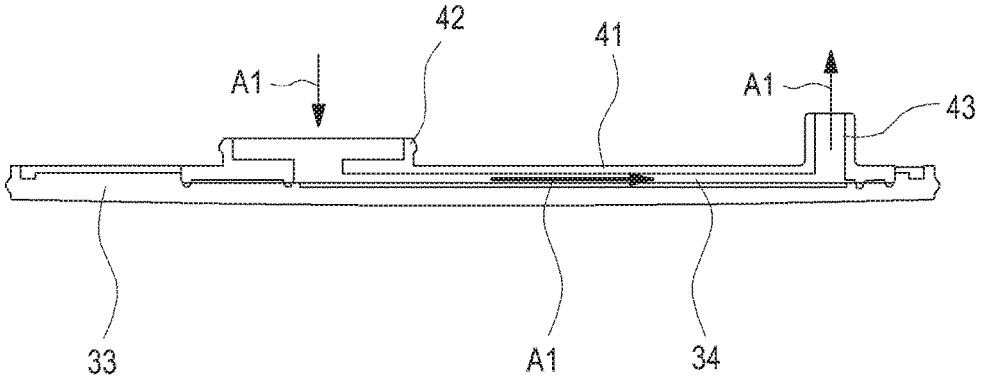
FIG. 12 is a cross-sectional side view showing the operation state of the first movement member in the configuration of a cosmetic vessel according to various embodiments of the present disclosure.

Next, the first movement member 40 will be described in more detail as follows. FIG. 10 is a plan view showing the combined state of the lower case 23 and the lower container part 33 in the configuration of the cosmetic vessel 10 according to the present disclosure, and FIG. 11 is a plan view showing the first movement member 40 in the configuration of the cosmetic vessel 10 according to the present disclosure. FIG. 12 is a cross-sectional side view showing the operation state of the first movement member 40 in the configuration of the cosmetic vessel 10 according to the present disclosure.

First, as shown in FIGS. 3 and 5 described above, the first movement member 40 includes a movement body 41, a cosmetic inlet 42, and a cosmetic movement hole 43.

The movement body 41 is formed with a cosmetic inlet 42 and a cosmetic movement hole 43, which will be described below.

The cosmetic inlet 42 is formed in one end of the movement body so as to be connected with a through hole, which is formed in a lower portion of the first receiving room 32*a* of the middle container part 32, for communication therewith.

The cosmetic movement hole 43 is connected with an introducing hole 71*a* of the lateral pump 70 so as to move the cosmetic substance A1 introduced through the cosmetic inlet 42 into the lateral pump 70.

That is, as shown in FIGS. 10 to 12, the first movement path 34 is coupled to the lower case 23, and the cosmetic inlet 42 formed in one end of the first movement path 34 is connected to the through hole of the first receiving room 32*a* to communicate therewith so that the cosmetic substance A1 of the first receiving room 32*a* is introduced. The introduced cosmetic substance A1 is moved and transferred to the cosmetic movement hole 43, which is formed in the other end of the first movement path 34, along the first movement path 34, and the cosmetic substance A1 in the cosmetic movement hole 43 is introduced into the lateral pump 70 through the introducing hole 71*a* formed on the lateral pump 70.

Figure 13:
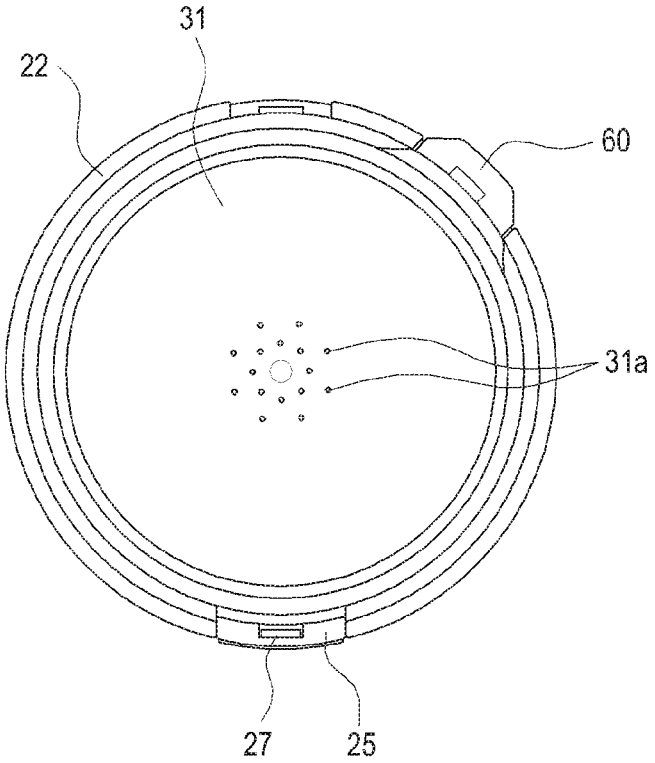
FIG. 13 is a plan view showing an upper container part in the configuration of a cosmetic vessel according to various embodiments of the present disclosure.
Figure 14:
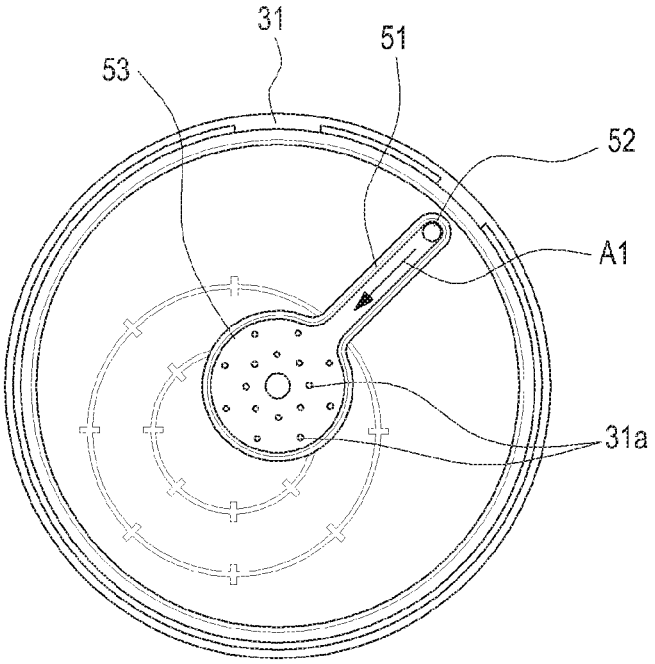
FIG. 14 is a plan view showing a second movement member in the configuration of a cosmetic vessel according to various embodiments of the present disclosure.
Figure 15:
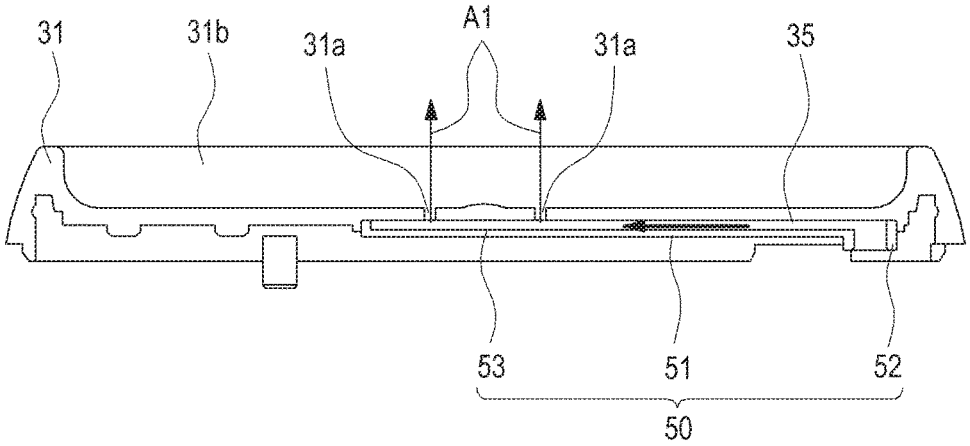
FIG. 15 is a cross-sectional side view showing the operation state of the upper container part and the second movement member in the configuration of a cosmetic vessel according to various embodiments of the present disclosure.

Now, the second movement member 50 will be described in more detail as follows. FIG. 13 is a plan view showing the upper container in the configuration of the cosmetic vessel 10 according to the present disclosure, and FIG. 14 is a plan view showing the second movement member 50 in the configuration of the cosmetic vessel 10 according to the present disclosure. FIG. 15 is a cross-sectional side view showing the operation state of the upper container part and the second movement member 50 in the configuration of the cosmetic vessel 10 according to the present disclosure.

First, as shown in FIGS. 3 and 6 described above, the second movement member 50 includes a movement body 51, a connecting hole 52, and a movement connecting portion 53.

The movement body 51 is formed with the connecting hole 52 and the movement connecting portion 53, which will be described below.

The connecting hole 52 is formed in one end of the movement body 51 so as to be connected with a discharge hole 71*b* of the lateral pump 70.

The movement connecting portion 53 is formed in the other end of the movement body 51 so as to be connected with the connecting hole 52, thereby moving the cosmetic substance A1 to the outer discharge holes 31*a* of the outer container 20.

That is, as shown in FIGS. 13 to 15, since the second movement path 35 is connected to the discharge hole 71*b* of the lateral pump 70, the cosmetic substance Al discharged through the discharge hole 71*b* may be moved to the movement connecting portion 53. The movement connecting portion 53 discharges the moved cosmetic substance A1 to the discharge recess 31*b* through the outer discharge holes 31*a* of the outer container 20. Then, the cosmetic substance is exposed to the outside for use by the user.

Further, the lateral pump 70 will be described in more detail as follows. First, as shown in FIGS. 3 and 7, the lateral pump 70 includes a pump housing 71, a pumping rod 72, a piston 73, a guide 74, a housing cap 75, an elastic member 76, and a disc 77.

The pump housing 71 has an introducing hole 71*a* formed to be connected to the cosmetic movement hole 43 of the first movement member 40 and a discharge hole 71*b* formed to be connected to the connecting hole 52 of the second movement member 50. In addition, the pump housing 71 is configured to receive the pumping rod 72, the piston 73, the housing cap 75, the elastic member 76, and the disc 77 therein.

One end of the pumping rod 72 is coupled to the lateral button 60, and the other end of the pumping rod 72 has a movement opening/closing portion 72*a* provided to open and close the piston 73 and the guide 74.

The piston 73 is provided in the pumping rod 72 so as to move in the pump housing 71 in order to thereby create pressure while opening and closing the discharge hole 71*b* when the lateral button 60 is pressed and released to reciprocate left and right.

The guide 74 is connected to the pumping rod 72 such that the pumping rod 72 passes through the guide 74 in order to guide the cosmetic substance A1 to the discharge hole 71*b* when the pumping rod 72 and the piston 73 reciprocate left and right.

The housing cap 75 is coupled to the pump housing 71 to close the same while the pumping rod 72, the piston 73, and the guide 74 are received in the pump housing 71. That is, the pump housing 71 has an opening formed in one side thereof, and the housing cap 75 is coupled to close the opening.

The elastic member 76 is provided between the housing cap 75 and the lateral button 60 so as to provide elastic force to allow the lateral button 60 to reciprocate left and right or to move the piston 73 for creating pressure.

The disc 77 is provided in the introducing hole 71*a* of the pump housing 71 so as to open and close the same by pressure.

In addition, the housing cap 75 is provided with a soft sealing member 80 for sealing the pump housing 71 while being coupled to the pumping rod 72 and the guide 74. That is, the soft sealing member 80 seals the pump housing 71 and provides elasticity such that the pumping rod 72 can be moved by pressing the lateral button 60.

Figure 17:
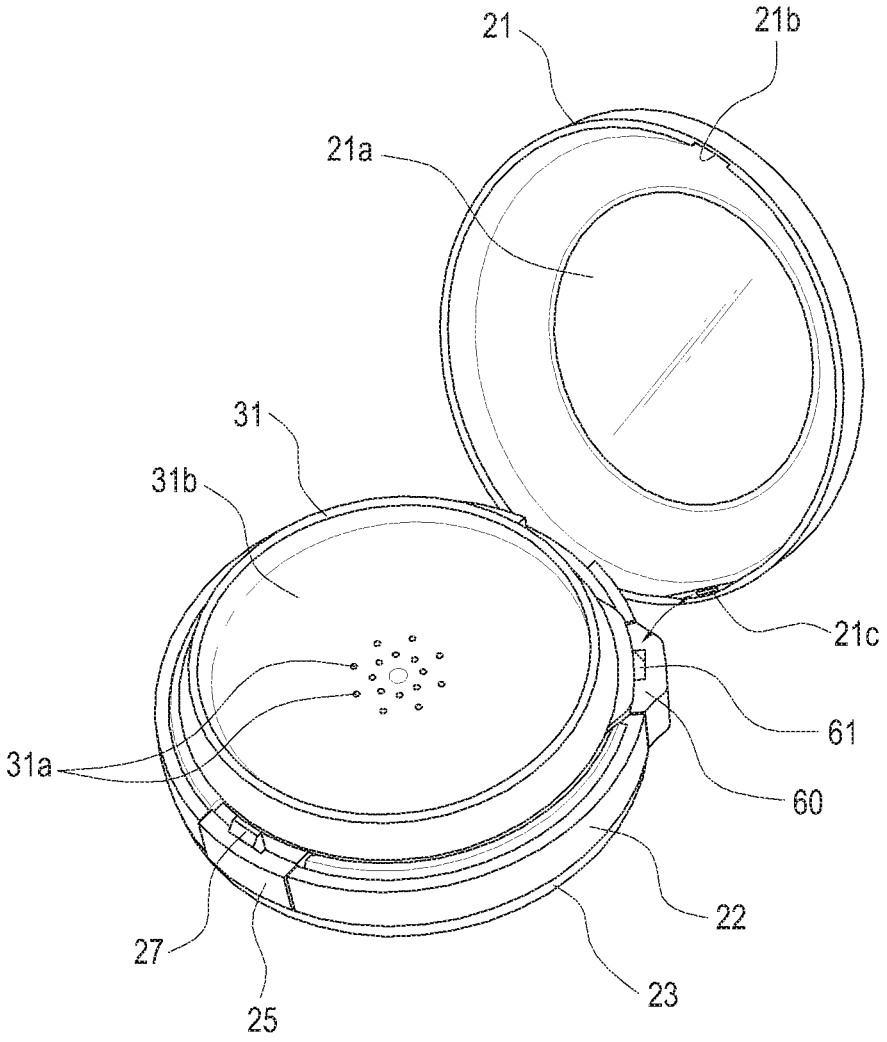
FIG. 17 is a perspective view showing the operation state of a button stopper of the lateral button in the configuration of a cosmetic vessel according to various embodiments of the present disclosure.
Figure 18:
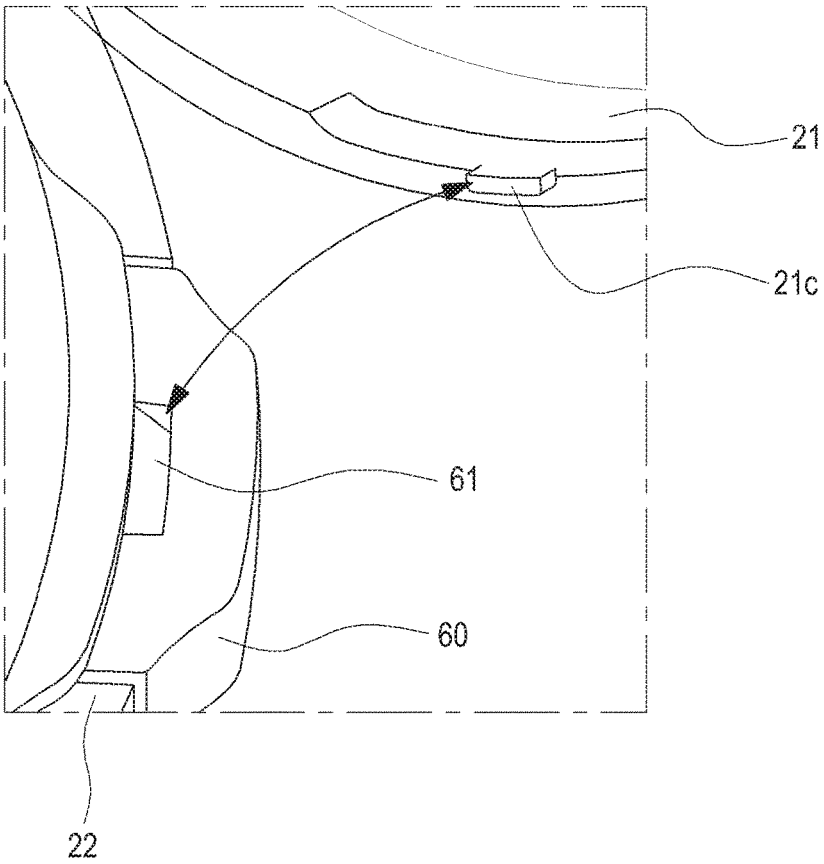
FIG. 18 is an enlarged perspective view showing the operating state of a button stopper of a lateral button in the configuration of a cosmetic vessel according to various embodiments of the present disclosure.

As shown in FIGS. 17 and 18, the lateral button 60 is provided with a button stopper 61 to prevent the lateral button 60 from being pressed depending on the engagement and disengagement of a locking protrusion 21*c* formed in the upper case 21 of the outer container 20. That is, since the button stopper 61 is engaged with the locking protrusion 21*c* of the upper case 21 while the upper case 21 is closed, the lateral button 60 cannot be pressed due to the button stopper 61 even by pressing the lateral button 60. When the upper case 21 is pivoted to open the same, the locking protrusion 21*c* of the upper case 21 moves therewith to then be disengaged from the button stopper 61, enabling the lateral button 60 to be pressed.

Figure 8:
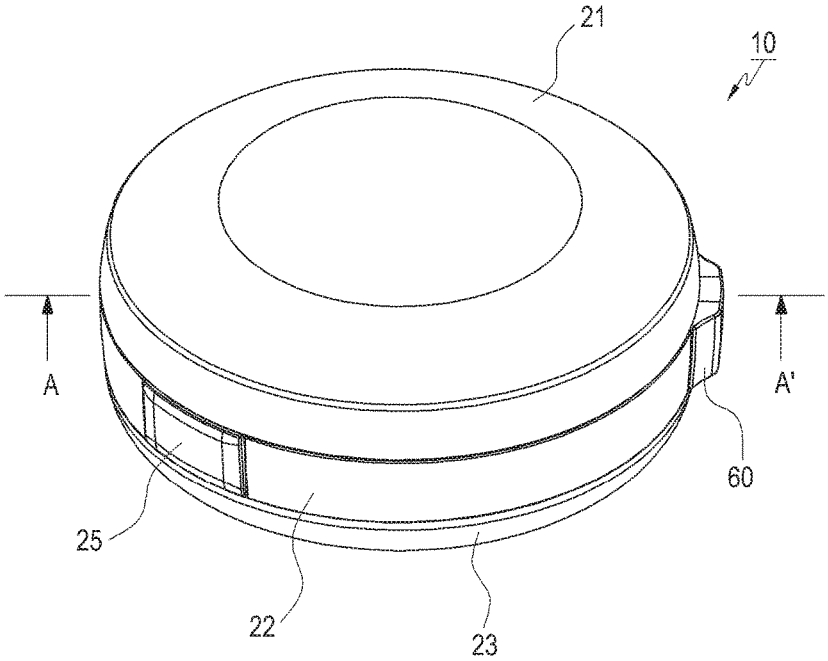
FIG. 8 is a perspective view showing the combined state of a cosmetic vessel according to various embodiments of the present disclosure.

Hereinafter, the assembly of the cosmetic vessel 10 will be described. First, FIG. 8 is a perspective view showing the combined state of the cosmetic vessel 10 according to various embodiments of the present disclosure, and FIG. 9 is a cross-sectional view taken along the line A-A' of FIG. 8, which shows the combined state of the cosmetic vessel 10.

Figure 9:
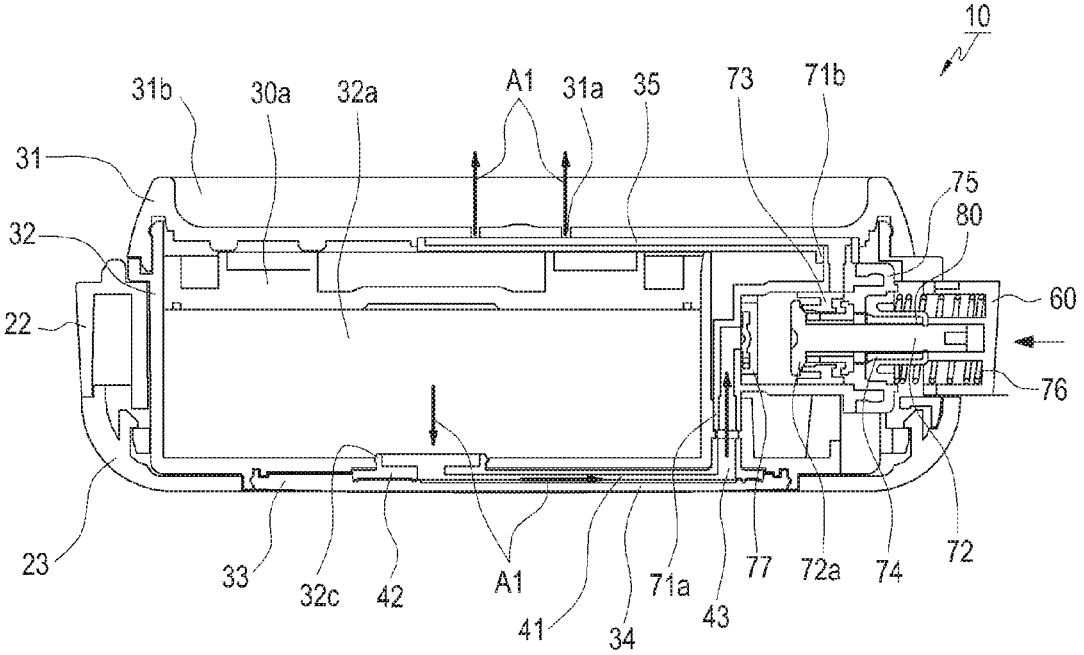
FIG. 9 is a cross-sectional view taken along the line A-A' in FIG. 8.

As shown in FIGS. 3 and 9 mentioned above, the cosmetic vessel 10 includes: the outer container 20 comprised of the upper case 21, the middle case 22, and the lower case 23; the inner container 30 comprised of the upper container part 31, the middle container part 32, and the lower container part 33; the first and second movement members 40 and 50; the lateral button 60; and the lateral pump 70.

The upper case 21 is pivotably coupled to the middle case 22 by the hinge 24, and the lower case 23 is coupled to the lower portion of the middle case 22. The push button 25 and the push spring 26 are seated in the seating hole 22*a* formed in the middle case 22.

In this state, the lower container part 33 is coupled to a coupling hole formed in the lower case 23. The lower container part 33 is provided in a lower portion of the middle container part 32 and includes the first movement member 40. At this time, the lower container part 33 is coupled to the first movement member 40 to form the first movement path 34. The cosmetic inlet 42 formed in one end of the first movement member 40 is connected to the through hole to communicate with each other, which is formed at the bottom of the middle case 22.

The first receiving room 32*a* of the middle case 22 receives the cosmetic substance A1 and the piston 30*a*, and the second receiving room 32*b* of the middle case 22 receives the lateral pump 70. The introducing hole 71*a* of the lateral pump 70 is connected to the cosmetic movement hole 43 formed in the other end of the first movement member 40.

The upper container part 31 is coupled to the upper portion of the middle container part 32. At this time, the second movement member 50 is provided between the middle container part 32 and the upper container part 31. The second movement member 50 is coupled to the upper container part 31 so as to form the second movement path 35.

The connecting hole 52 formed in one end of the second movement path 35 is connected to the discharge hole 71*b* of the lateral pump 70, and the movement connecting portion 53 formed in the other end of the second movement path 35 is connected to the connecting hole 52. The movement connecting portion 53 is positioned in the outer discharge holes 31*a* of the outer container 20.

The inner container 30 assembled in the above-described manner is coupled to the middle case 22, and at this time, the lateral button 60 is exposed to the outside while being connected to a hole formed in the middle case 22.

In this state, as shown in FIG. 17, the upper case 21 is pivoted to thus be closed. At this time, the locking groove 21*b* formed in the upper case 21 is hooked by the hook 27 formed on the push button 25 to then be locked. In addition, as shown in FIG. 18, the locking protrusion 21*c* formed in the upper case 21 is inserted into the button stopper 61 formed in the lateral button 60, thereby preventing the lateral button 60 from being pressed.

Figure 16A:
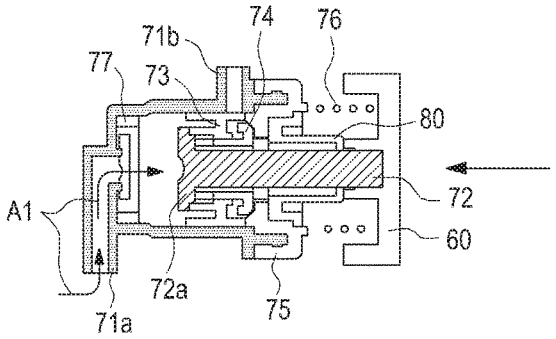
FIGS. 16A to 16E are cross-sectional side views showing the operation state of a lateral pump in the configuration of a cosmetic vessel according to various embodiments of the present disclosure.
Figure 16B:
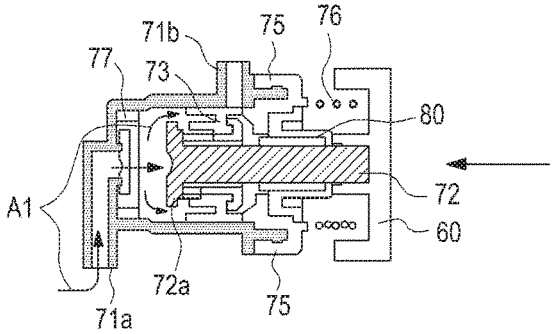
Figure 16C:
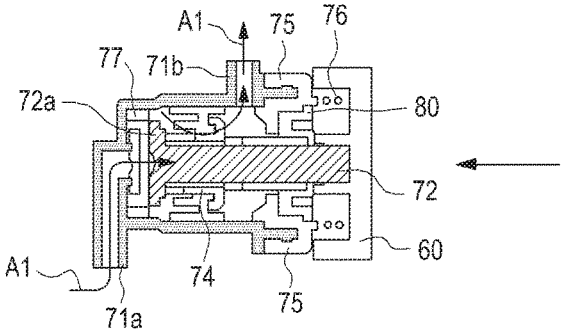
Figure 16D:
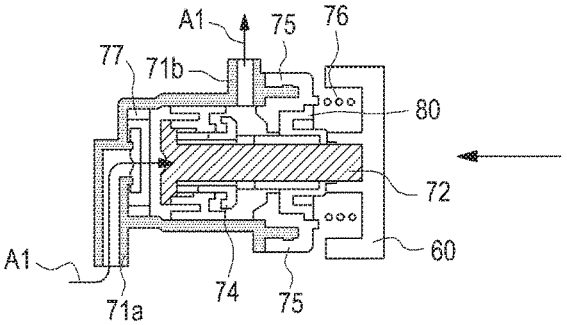
Figure 16E:
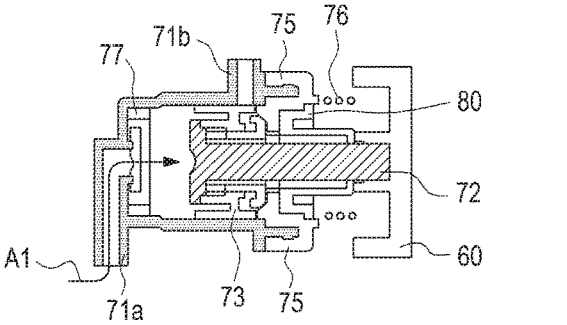

Now, the operation of the assembled cosmetic vessel 10 will be described. FIG. 16A is a view showing the state before the lateral pump 70 is operated according to the present disclosure, and FIG. 16B is a view showing the operation state of the lateral pump 70 when the lateral button 60 is pressed, according to the present disclosure. FIG. 16C is a view showing the operation state of the lateral pump 70 while the lateral button 60 is fully pressed, according to the present disclosure, and FIG. 16D is a view showing the operation state of the lateral pump 70 when the lateral button 60 is released, according to the present disclosure. FIG. 16E is a view showing the operation state of the lateral pump 70 when the lateral button 60 has returned to the original position, according to the present disclosure.

As shown in FIG. 9 described above, the push button 25 provided in the middle case 22 of the outer container 20 is pushed. The push button 25 is moved toward the inside of the vessel, and the hook 27 provided in the push button 25 moves therewith. The hook 27 is disengaged from the locking groove 21*b* formed in the upper case 21, and in this state, the upper case 21 pivots around the hinge 24 to open the upper container part 31 of the inner container 30.

When the lateral button 60 formed in the middle case 22 is pressed, the lateral button 60 is moved toward the inside of the middle case 22 from the right to the left while the pumping rod 72 is moved together with the lateral button 60 as shown in FIGS. 16A and 16B. In addition, the piston 73 is moved together with the pumping rod 72 to generate pressure. At this time, the movement opening/closing portion 72*a* of the pumping rod 72 is moved as well so as to be separated from the side of the piston 73 and to then be opened. Therefore, the cosmetic substance A1 positioned in the left side of the piston 73 is moved to the right side thereof while being guided by the guide 74. Here, the discharge hole 71*b* of the pump housing 71, which has been closed by the side surface of the piston 73, is opened as the piston 73 moves. Thus, the cosmetic substance A1, which has been moved to the right side of the piston, is discharged through the opened discharge hole 71*b*. The discharged cosmetic substance A1 is transferred to the connecting hole 52 of the second movement member 50, and the cosmetic substance A1 transferred to the connecting hole 52 is discharged to the outside through the outer discharge holes 31*a* of the upper container part 31. The cosmetic substance A1 is collected in the discharge recess 31*b* of the upper container part 31, and the user uses the cosmetic substance A1 discharged in the discharge recess 31*b*.

Here, when the pressed lateral button 60 is released as shown in FIG. 16C, the lateral button 60 moves in the reverse direction from the left to the right (that is, the lateral button 60 moves toward the outside of the middle case 22 as shown in FIGS. 16D and 16E). When the lateral button 60 moves, the pumping rod 72 and the piston 73 move as well. The movement opening/closing portion 72*a* of the pumping rod 72 blocks one side of the piston 73. At this time, the piston 73 and the pumping rod 72 move together to generate pressure, so that the cosmetic substance A1 may be additionally discharged through the opened discharge hole 71*b* of the pump housing 71. That is, since the discharge hole 71*b* remains open until the piston 73 returns to its original position, the cosmetic substance A1 may be discharged through the opened discharge hole 71*b*. In other words, the cosmetic substance A1 is discharged until the discharge hole 71*b* is closed while the piston 73 moves, and when the discharge hole 71*b* is closed, the discharging of the cosmetic substance A1 is stopped.

That is, when the piston 73 and the pumping rod 72 return to the original position, the discharge hole 71*b* is closed by the side surface of the piston 73, and the movement opening/closing portion 72*a* of the pumping rod 72 closes one side of the piston 73.

At this time, the disc 77, which has blocked the introducing hole 71*a* of the pump housing 71, opens the introducing hole 71*a* due to the generated pressure. Since the opened introducing hole 71*a* is connected to the cosmetic movement hole 43 of the first movement member 40, the cosmetic substance A1 transferred to the cosmetic movement hole 43 of the first movement member 40 may be introduced into the pump housing 71 through the introducing hole 71*a*. That is, the pressure generated in the pump housing 71 may open the disc 77, and may move the cosmetic substance A1 transferred to the cosmetic movement hole 43 of the first movement member 40. That is, since the cosmetic movement hole 43 is connected to the cosmetic inlet 42 of the first movement member 40, the cosmetic substance A1 introduced through the cosmetic inlet 42 may be transferred to the cosmetic movement hole 43. Since the cosmetic inlet 42 is connected to the through hole, which is formed in the lower portion of the first receiving room 32*a* of the middle container part 32, to communicate with each other, the cosmetic substance A1 provided in the first receiving room 32*a* may be introduced through the cosmetic inlet 42 by pressure. At this time, the piston 30*a* provided in the first receiving room 32*a* is moved downward by the pressure so that the cosmetic substance A1 may be introduced through the cosmetic inlet 42.

Here, when the lateral button 60 is pressed again, the piston 73 moves from the right to the left to generate pressure, and the disc 77 closes the opened introducing hole 71*a* of the pump housing 71. Since the subsequent operations thereof have been described above, a detailed description thereof will be omitted.

Accordingly, it is possible to use the cosmetic substance A1 that is discharged when the lateral button 60 reciprocates left and right by being pressed or released.

As described above, since the cosmetic vessel adopting the conventional pressurized pumping device has a structure in which the cosmetic substance is discharged when the operating button is pressed once from the top down, if a small amount of cosmetic substance A1 is discharged when the user presses the operating button once, the user must repeatedly press the operating button several times from the top down, which is tiresome to the user. In addition, since the conventional pressurized pumping device has a structure in which the cosmetic substance is discharged directly onto the user's hands, it has problems in which the cosmetic substance A1 overflows the user's hands or may spill on the floor to thus be wasted.

In order to overcome the problems above, the present embodiment is configured to discharge the cosmetic substance to the outside when pressing or releasing the lateral button 60 (shown in FIG. 3), instead of pressing the same several times, thereby improving the discharging of the cosmetic substance from the vessel. Further, according to the present embodiment, it is possible to prevent the cosmetic substance from spilling to be wasted, compared to the case where the cosmetic substance is discharged directly onto the user's hands, by discharging the cosmetic substance to the upper container part 31 (shown in FIG. 3) of the cosmetic vessel 10 (shown in FIG. 3) rather than the user's hands.

While the present disclosure has been shown and described with reference to certain embodiments thereof, it will be apparent to those skilled in the art that the camera lens module according to the present disclosure is not limited to these embodiments, and various changes in form and details may be made therein without departing from the spirit and scope of the present disclosure as defined by the appended claims.

What is claimed is:

1. A cosmetic vessel comprising:

an outer container;

an inner container that is coupled inside the outer container, and receives a cosmetic substance therein;

first and second movement members that are provided in upper and lower portions of the inner container and move the cosmetic substance by pressure;

a lateral button that is provided on a side of the outer container; and a lateral pump that is mounted on the side of the inner container so as to be connected to the first and second movement members, and provides the pressure every time the lateral button is pressed and released to reciprocate left and right so as to move the cosmetic substance from the first movement member to the second movement member by the pressure.

2. A cosmetic vessel comprising:

an outer container;

an inner container that is coupled inside the outer container so as to receive the cosmetic substance and a piston therein, and discharges the cosmetic substance to the outer container by descent of the piston;

first and second movement members that are provided in upper and lower portions of the inner container, and move the cosmetic substance by pressure;

a lateral button that is provided on a side of the outer container; and a lateral pump that is mounted on the side of the inner container so as to be connected to the first and second movement members, and provides the pressure every time when the lateral button is pressed and released to reciprocate left and right so as to move the cosmetic substance from the first movement member to the second movement member by the pressure.

3. The cosmetic vessel of claim 2, wherein the outer container comprises:

an upper case that has a mirror provided therein;

a middle case that is pivotably coupled to a lower portion of the upper case by a hinge and receives the inner container therein; and a lower case that is provided in a lower portion of the middle case.

4. The cosmetic vessel of claim 3, wherein the middle case comprises:

a push button that is provided on an outer side of the middle case and is locked or released while being moved by pushing the same so as to prevent or allow pivoting of the upper case; and a push spring that is provided in the push button so as to provide an elastic force for moving the push button.

5. The cosmetic vessel of claim 4, wherein the push button has a hook provided to be locked with, or released from, a locking groove formed in the upper case.

6. The cosmetic vessel of claim 3, wherein the middle case has a seating hole formed to seat the lateral button therein.

7. The cosmetic vessel of claim 3, wherein the inner container comprises an upper container part, a middle container part, and a lower container part;

the middle container part is formed with a first receiving room for receiving the cosmetic substance and the piston and a second receiving room for receiving the lateral pump;

the lower container part is provided in a lower portion of the middle container part so as to be coupled to the lower case and is coupled to the first movement member so as to form a first movement path for moving the cosmetic substance; and the upper container part is provided in an upper portion of the middle container part and is coupled to the second movement member so as to move the cosmetic substance.

8. The cosmetic vessel of claim 7, wherein the upper container part has a plurality of outer discharge holes formed to discharge the cosmetic substance to the outside.

9. The cosmetic vessel of claim 7, wherein the first movement member comprises:

a movement body;

a cosmetic inlet that is formed in one end of the movement body, and is connected to a through hole, which is formed in a lower portion of the first receiving room of the middle container part, to communicate therewith; and a cosmetic movement hole that is formed in the other end of the movement body so as to be connected with a pump introducing hole such that the cosmetic substance introduced through the cosmetic inlet is moved into the lateral pump.

10. The cosmetic vessel of claim 2, wherein the second movement member comprises:

a movement body;

a connecting hole that is formed in one end of the movement body so as to be connected to a discharge hole of the lateral pump; and a movement connecting portion that is formed in the other end of the movement body so as to be connected to the connecting hole such that the cosmetic substance is moved to an outer discharge hole of the outer container.

11. The cosmetic vessel of claim 2, wherein the lateral pump comprises:

a pump housing that has an introducing hole connected to a cosmetic movement hole of the first movement member, and a discharge hole connected to a connecting hole of the second movement member;

a pumping rod that is provided in the pump housing such that one end thereof is coupled to the lateral button and the other end thereof has a movement opening/closing portion provided therein;

a piston that is provided in the pumping rod so as to be moved in the pump housing when the lateral button reciprocates left and right by being pressed and released, thereby generating pressure and thereby opening and closing the discharge hole;

a guide that is coupled to the pumping rod such that the pumping rod passes through the same so as to guide and move the cosmetic substance to the discharge hole when the pumping rod and the piston reciprocate left and right;

a housing cap that is coupled to the pump housing;

an elastic member that is provided between the housing cap and the lateral button, and provides an elastic force to allow the lateral button to reciprocate left and right or to move the piston, thereby generating pressure; and a disc that is provided in the introducing hole so as to open and close the introducing hole by pressure.

12. The cosmetic vessel of claim 11, wherein the housing cap is provided with a soft sealing member coupled to the pumping rod and the guide so as to seal the pump housing.

13. The cosmetic vessel of claim 2, wherein the lateral button is formed with a button stopper that prevents the lateral button from being pressed according to engagement and disengagement of a locking protrusion formed in the upper case of the outer container.

* * * * *